United States Patent [19]

Toloczko

[11] 3,934,691

[45] Jan. 27, 1976

[54] ICE DISPENSING SYSTEM OF A REFRIGERATOR-FREEZER

[75] Inventor: Henry A. Toloczko, Louisville, Ky.

[73] Assignee: General Electric Company, Louisville, Ky.

[22] Filed: Dec. 6, 1974

[21] Appl. No.: 530,175

[52] U.S. Cl. ..... 193/32; 62/266

[51] Int. Cl.[2] ..... B65G 11/20

[58] Field of Search ..... 62/344, 265, 266, 351; 193/32; 222/146 C, 146 R, 146 H, 490, 491, 494; 137/59, 525.1, 341; 221/310, 150, 221/150 A, 150 HC; 302/59

[56] References Cited

UNITED STATES PATENTS

| | | | |
|---|---|---|---|
| 2,889,906 | 6/1959 | Linderoth | 193/32 |
| 2,890,081 | 6/1959 | Terrett | 302/59 |
| 3,537,273 | 11/1970 | Alvarez | 62/266 |
| 3,718,237 | 2/1973 | Gittelson et al. | 222/505 |

*Primary Examiner*—Drayton E. Hoffman
*Assistant Examiner*—Hadd Lane

[57] ABSTRACT

An ice-discharge chute of an ice-dispensing system of a refrigerator-freezer has first and second spaced-apart doors, each formed of a plurality of deflectable overlapping elements. The elements of each door are movable between a first position at which the elements seal the chute for preventing the passage of air therethrough and a second position at which the elements are deflected downwardly in response to contact by an ice piece for passage of the ice piece through the door and the chute. Heating elements are associated with the overlapping portions of at least a portion of the deflectable elements for preventing freezing of one element to another.

6 Claims, 3 Drawing Figures

ICE DISPENSING SYSTEM OF A REFRIGERATOR-FREEZER

BACKGROUND OF THE INVENTION

This invention pertains generally to ice-dispensing means for refrigerators-freezers. Freezer compartments of refrigerators are known which contain ice-making units capable of producing and storing pieces of ice in predetermined amounts. Ice dispensers are now being provided which include through-the-door ice-delivery passageways so that cubes and crushed ice can be obtained without opening the freezer or refrigerator. An example of this type of dispenser is described in U.S. Pat. No. 3,537,273-Alvarez. "Cubes", of course, is the general term now employed for pieces of ice other than crushed, whether they are hexahedral, cylindrical, crescentshaped, or in the form of irregular chunks. The term refers more to the size of the ice piece, four to six cubes generally filling an ordinary drinking glass.

A desirable ice dispenser of the type having a passageway through the refrigerator-freezer door is illustrated in U.S. Pat. No. 3,718,237-Gittelson et al. This dispenser includes a slanting ice-conveying passageway extending from an ice maker storage receptacle, diagonally downwardly through the refrigerator-freezer door to an outlet which opens into a recessed service area in the refrigerator door itself. Since the recessed service area is on the outside of the door, ice is available without the door being opened. As the ice-conveying passageway must be kept closed except during use, to prevent warm air from entering the freezing compartment, a normally closed, closure member is adapted to close the outlet.

Satisfactory operation of dispensers of this type depends to a great extent on the proper operation of the closure member. It was essential that the temperature of the chute normally be below freezing temperatures. Otherwise, discharged cubed and crushed ice melted, stuck to the chute and froze within the chute when the closure member was closed. In order to aid in preventing the chute from being excessively warm during use, the opening of the closure member was synchronized with the operation of the ice ejector. This was by pivotal operation of the closure member.

The closure members of the heretofore utilized ice-dispensing apparatus solved many of the problems which have been described. Nevertheless, they are subject to improvement. These heretofore utilized closure members or doors had a relatively large number of moving parts and were sometimes subject to being displaced from alignment.

It is therefore desirable to provide a closure which is of simple construction and has improved performance.

SUMMARY OF THE INVENTION

In accordance with this invention, an ice-dispensing system of a refrigerator-freezer has an ice-discharge chute passing through a wall of the refrigerator-freezer. First and second doors, or closure members, are positioned within the chute at locations spaced one from the other along the length of the chute. Each of the doors comprises a plurality of deflectable elements. The deflectable elements are each attached at one edge about the inner walls of the chute and extend toward the chute axis in overlapping relationship. The elements of each door are movable between a first position at which the elements seal the chute and a second position at which the elements are deflected downwardly in response to contact by an ice piece for passage of the ice piece through the door and the chute. Heating elements are associated with the overlapping portions of at least a portion of the deflectable elements for preventing freezing of one element to another.

DETAILED DESCRIPTION OF THE INVENTION

Figure 1:
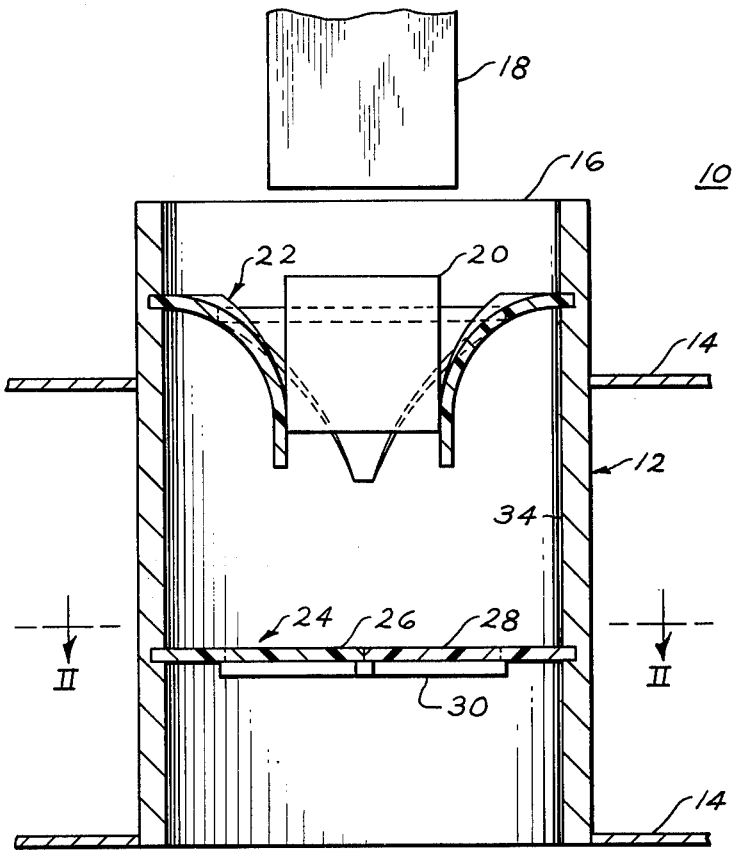
FIG. 1 is a diagrammatic, longitudinal, sectional view of the ice-discharge chute and the apparatus of this invention.
Figure 2:
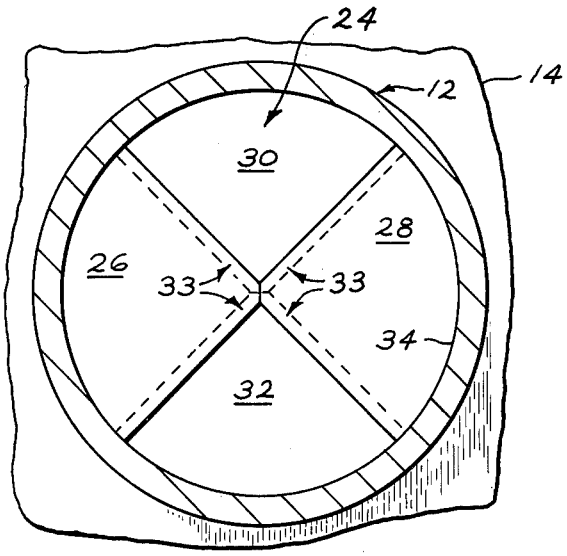
FIG. 2 is a diagrammatic view of the ice-discharge chute taken along lines II—II of FIG. 1.

In the embodiment of FIGS. 1 and 2, an ice-dispensing system of a refrigerator-freezer 10 has an ice-discharge chute 12 passing through a wall 14 of the refrigerator-freezer 10. The chute 12 has an inlet 16 positioned adjacent an ice-delivery apparatus 18 for recovering ice pieces 20 therefrom. The chute extends through the wall 14 in a downward direction for gravitational movement of the ice pieces 20 through the chute 12.

First and second doors 22, 24 or closure means are positioned within the chute 12 at locations spaced one from the other along the length of the chute 12. The spaced-apart distance of the doors is dependent upon the size of the ice pieces expected to be discharged through the chute 12. In order to reduce the amount of cold air passing through the chute from the refrigerator-freezer and/or warm air passing through the chute 12 and into the refrigerator-freezer, it is preferred that the doors be spaced one from the other a distance of at least 5.8 centimeters. At spacing less than 5.8 centimeters, an ice piece of a size generally associated with this apparatus would be sufficiently large to simultaneously maintain both doors 22, 24 in an open position. For reducing air flow through the chute 12, as set forth above, it is desirable that the spacing between the doors 22, 24 be sufficient to permit the first door 22 to at least be free from contact with the ice piece 20 at the moment of contact of the ice piece 20 with the second door 24.

Each of the doors 22, 24 are formed of a plurality of deflectable, resilient elements 26, 28, 30, 32. An example material which has been found to be useful in the construction of the doors 22, 24 is rubber.

The deflectable elements 26, 28, 30, 32 are each attached at one edge about the inner walls 34 of the chute 12 and extend toward the chute axis in overlapping relationship relative to adjacent elements. The elements 26, 28, 30, 32 can be secured to the inner walls by insertion of the edge into a groove formed on the chute inner wall 34. An example overlap of the elements that has been found effective in sealing the chute 12 is an overlap of about .15 centimeters.

It has also been found desirable to form a chute 12 having a columnar configuration and providing each door 22, 24 with at least four of the deflectable elements.

The elements 26, 28, 30, 32 are movable between a first position at which the elements 26, 28, 30, 32 seal the chute 12 (see door 24 of FIG. 2) and a second position (see door 22 of FIG. 1) at which the elements are deflected generally downwardly in response to contact by an ice piece 20 for passage of the ice piece 20 through the door and the chute 12.

Figure 3:
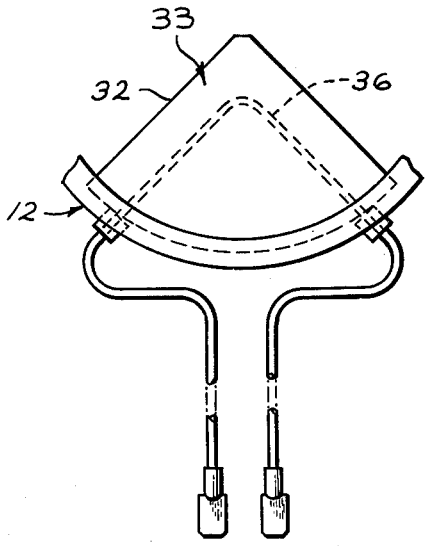
FIG. 3 is a diagrammatic view of one of the deflectable elements having a heating element.

In the embodiment of FIG. 3, a heating element 36 is associated within the overlapping portion 33 of the deflectable element for preventing freezing of one inlet to another. It is preferred that the heating element 36 be associated with each overlap portion 33 of the deflectable elements. These heating elements 36 can be an electrical resistance wire, as is known in the art, and be embedded in or attached to an outer surface of the deflectable elements along the overlap edge portion 33 thereof. The heating elements are preferably intermittently energized in response to the discharge of ice pieces through the chute 12.

In the operation of this invention, as an ice piece 20 is discharged from the ice-delivery apparatus 18, it passes into the inlet 16 of the chute 12 and falls by gravity into contact with the first door 22. The weight of the ice piece 20 causes the deflectable elements 26, 28, 30, 32 of the first door 22 to move from the closed first position to the open second position for passage of the ice piece 20 through the first door 22. The resilience of the elements 26, 28, 30, 32 thereafter causes the deflectable elements 26, 28, 30, 32 to return to their first, closed position. The ice piece 20 then passes through the middle portion of the chute 12, contacts the second door 24 which similarly functions and permits the ice piece to pass through the chute 12. The heating elements 36 sufficiently heat the overlapping portions 33 of the elements 26, 28, 30, 32 to prevent the freezing and sticking of the elements one to the other.

Other modifications and alterations of this invention will become apparent to those skilled in the art from the foregoing discussion, and it should be understood that this invention is not to be unduly limited thereto.

What is claimed is:

1. In an ice-dispensing system of a refrigerator-freezer having an ice-discharge chute passing through a wall of the refrigerator-freezer, the improvement comprising:

first and second doors positioned within the chute at locations spaced one from the other along the length of the chute, each of said doors comprising a plurality of deflectable elements each attached at one edge about the inner walls of the chute and extending toward the chute axis in overlapping relationship, said elements being movable between a first position at which the elements seal the chute and a second position at which the elements are deflected in response to contact by an ice piece for passage of the ice piece through the door and the chute; and heating elements associated with the overlapping portions of at least a portion of the deflectable elements for preventing freezing of one element to another.

2. Apparatus, as set forth in claim 1, wherein each door comprises at least four deflectable elements.

3. Apparatus, as set forth in claim 1, wherein the heating element is a resistance wire extending along the overlapped portion of the deflectable element.

4. Apparatus, as set forth in claim 1, wherein the doors are spaced one from the other a distance along the chute axis of about 5.8 centimeters.

5. Apparatus, as set forth in claim 1, wherein the deflecting elements are formed of rubber.

6. Apparatus, as set forth in claim 1, wherein the chute is of columnar configuration.

* * * * *